US010143341B2

(12) United States Patent
Peleg

(10) Patent No.: US 10,143,341 B2
(45) Date of Patent: Dec. 4, 2018

(54) DAMP SHEETS DISPENSER

(71) Applicant: Ziv Peleg, Netanya (IL)

(72) Inventor: Ziv Peleg, Netanya (IL)

( * ) Notice: Subject to any disclaimer, the term of this patent is extended or adjusted under 35 U.S.C. 154(b) by 276 days.

(21) Appl. No.: 15/147,098

(22) Filed: May 5, 2016

(65) Prior Publication Data

US 2016/0324376 A1 Nov. 10, 2016

(30) Foreign Application Priority Data

May 7, 2015 (DE) ..... 20 2015 102 338 U

(51) Int. Cl.

| | |
|---|---|
| ***A47K 10/32*** | (2006.01) |
| ***A47K 10/36*** | (2006.01) |
| ***A47K 10/38*** | (2006.01) |
| ***B65H 16/00*** | (2006.01) |
| ***B65H 16/04*** | (2006.01) |
| ***B65H 16/10*** | (2006.01) |

(52) U.S. Cl.

CPC ..... *A47K 10/38* (2013.01); *A47K 10/3643* (2013.01); *A47K 10/3818* (2013.01); *B65H 16/005* (2013.01); *B65H 16/04* (2013.01); *B65H 16/106* (2013.01); *A47K 2010/3233* (2013.01); *A47K 2010/3266* (2013.01); *B65H 2404/144* (2013.01); *B65H 2701/1924* (2013.01)

(58) Field of Classification Search

CPC ..... A47K 10/38; A47K 10/3643; A47K 10/3818; A47K 2010/3266; A47K 2010/3233; B65H 16/106; B65H 16/005; B65H 16/04; B65H 2701/1924; B65H 2404/144

See application file for complete search history.

(56) References Cited

U.S. PATENT DOCUMENTS

| | | | | | |
|---|---|---|---|---|---|
| 2,135,767 | A * | 11/1938 | Price | A47K 10/36 | 226/131 |
| 2,685,445 | A * | 8/1954 | Kopf | A47K 10/36 | 226/130 |
| 5,765,717 | A * | 6/1998 | Gottselig | A47K 10/32 | 206/233 |
| 2008/0087680 | A1* | 4/2008 | Amundson | A47K 10/38 | 221/150 R |
| 2011/0068129 | A1* | 3/2011 | Maurer | A47K 10/34 | 222/192 |
| 2015/0196174 | A1* | 7/2015 | Goltz | A47K 10/3618 | 242/596 |
| 2016/0183744 | A1* | 6/2016 | Sadikov | A47K 10/38 | 118/249 |

* cited by examiner

*Primary Examiner* — William A. Rivera

(74) *Attorney, Agent, or Firm* — Alphapatent Associates, Ltd; Daniel J. Swirsky

(57) ABSTRACT

A damp sheets dispenser, including a compartment, for housing therein a damp roll, the compartment including: an openable cover, for inserting the damp roll into the compartment therethrough, and for closing the compartment, for dispensing the damp roll therefrom; a slit, for dispensing from damp roll therethrough at the closed state of the compartment; two rotatable cylinders disposed filling the slit, at the closed state of the compartment, for dispensing the damp roll therethrough; at least one sealing, for sealing the openable cover to surfaces of the compartment disposed adjacent thereto, thereby at the closed state, the compartment seals the damp roll housed therewithin, thereby maintaining the damp roll damped.

7 Claims, 5 Drawing Sheets

DAMP SHEETS DISPENSER

CROSS-REFERENCE TO RELATED APPLICATIONS

This application claims the benefit of priority from German Utility Model Application No. DE 20 2015 102 338.3, filed 7 May 2015, the disclosure of which is incorporated herein by reference.

TECHNICAL FIELD

The invention relates to the field of sheet dispensers. More particularly, the invention relates to dispensing of damp sheets.

BACKGROUND

Dry paper is marketed as flat sheets of as a roll. In contrast, damp cloth is marketed only as flat sheets, since the nylon wrapping it is which maintains the damp.

SUMMARY

In one aspect of the invention, the invention provides an apparatus for dispensing damp cloth.

In one aspect of the invention, the invention provides a solution to the above-mentioned and other problems of the prior art.

In one aspect, the invention is directed to a damp sheets dispenser, including a compartment, for housing therein a damp roll, the compartment including:

- an openable cover, for inserting the damp roll into the compartment therethrough, and for closing the compartment, for dispensing the damp roll therefrom;
- a slit, for dispensing from damp roll therethrough at the closed state of the compartment;
- two rotatable cylinders disposed filling the slit, at the closed state of the compartment, for dispensing the damp roll therethrough;
- at least one sealing, for sealing the openable cover to surfaces of the compartment disposed adjacent thereto, thereby at the closed state, the compartment seals the damp roll housed therewithin, thereby maintaining the damp roll damped.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of preferred embodiments of the invention, which are meant to be descriptive and not limiting. For the sake of brevity, some well-known features, methods, systems, procedures, components, circuits, and so on, are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
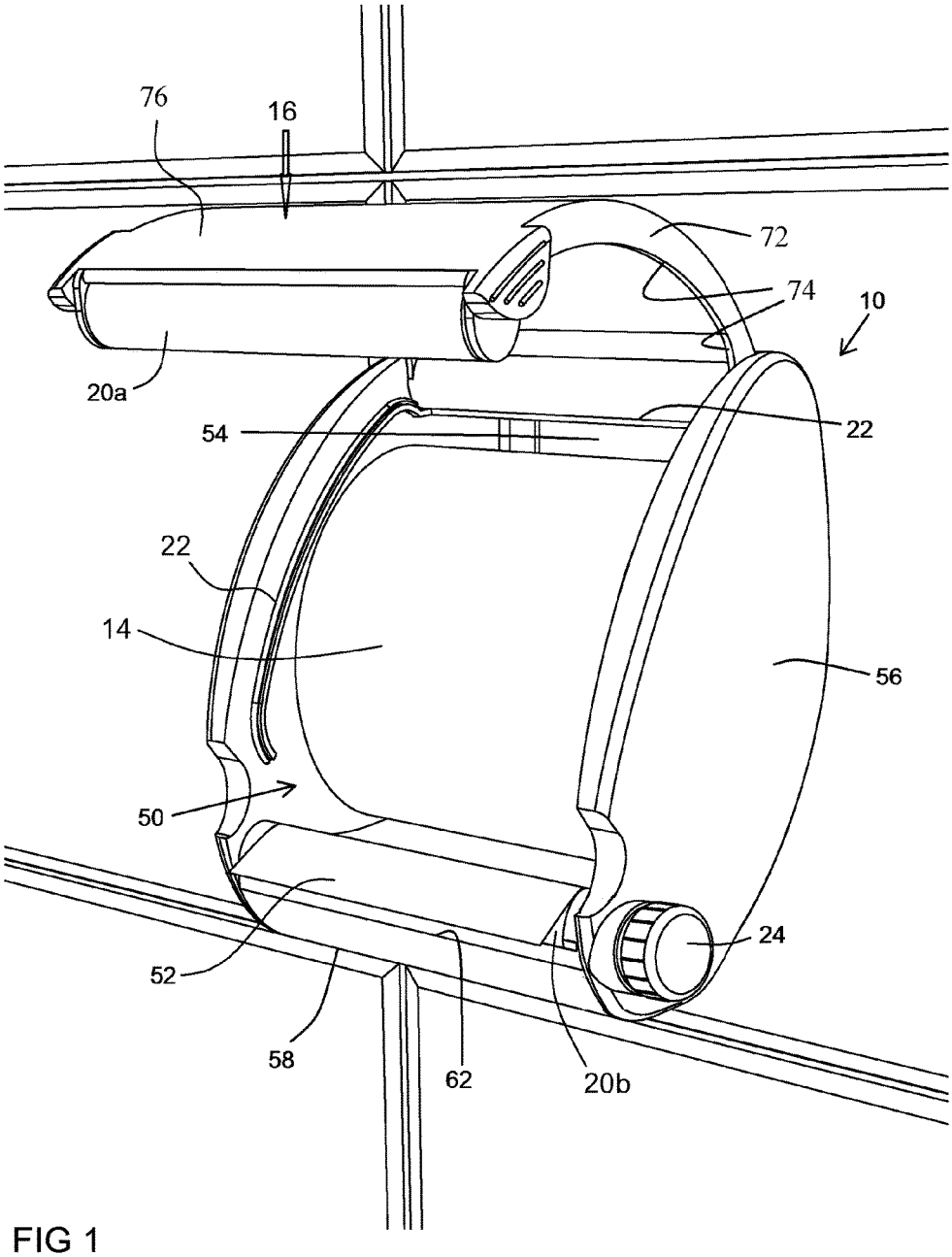
FIG. 1 is a perspective view of a damp sheets dispenser according to one embodiment of the invention, at the opened state.

FIG. 1 is a perspective view of a damp sheets dispenser according to one embodiment of the invention, at the opened state.

A damp sheets dispenser 10 includes an openable compartment 50, for inserting therein a damp roll 14, for then closing a cover 16 thereof, and for then dispensing damp sheets 52 out of compartment 50.

Compartment 50 includes a stationary rear surface 54, a stationary bottom surface 58, stationary side walls 56, and a movable cover 16.

Stationary rear surface 54, stationary rear wall 54, stationary side walls 56, and movable cover 16 make compartment 50 to be substantially sealed upon closing cover 16, for maintaining the dampness of damp roll 14.

Figure 2:
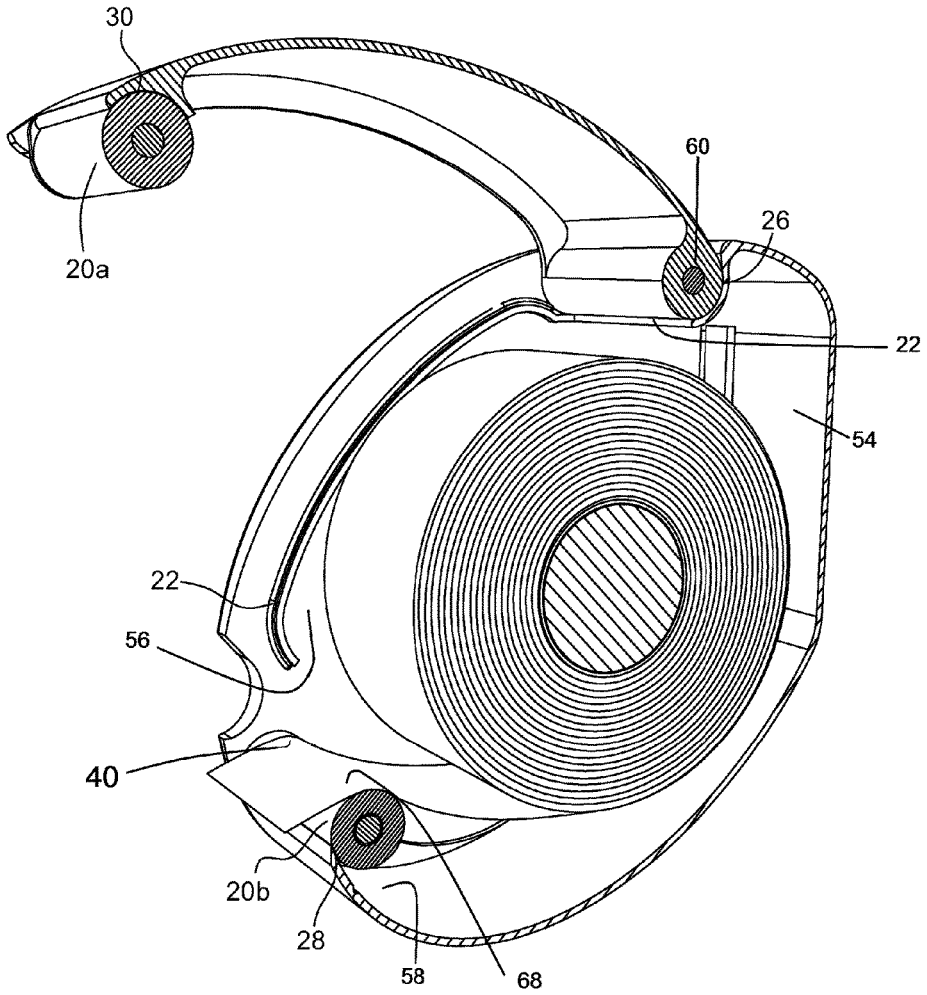
FIG. 2 is a sectional perspective view of the damp sheets dispenser of FIG. 1, at the opened state.

FIG. 2 is a sectional perspective view of the damp sheets dispenser of FIG. 1, at the opened state.

Figure 4:
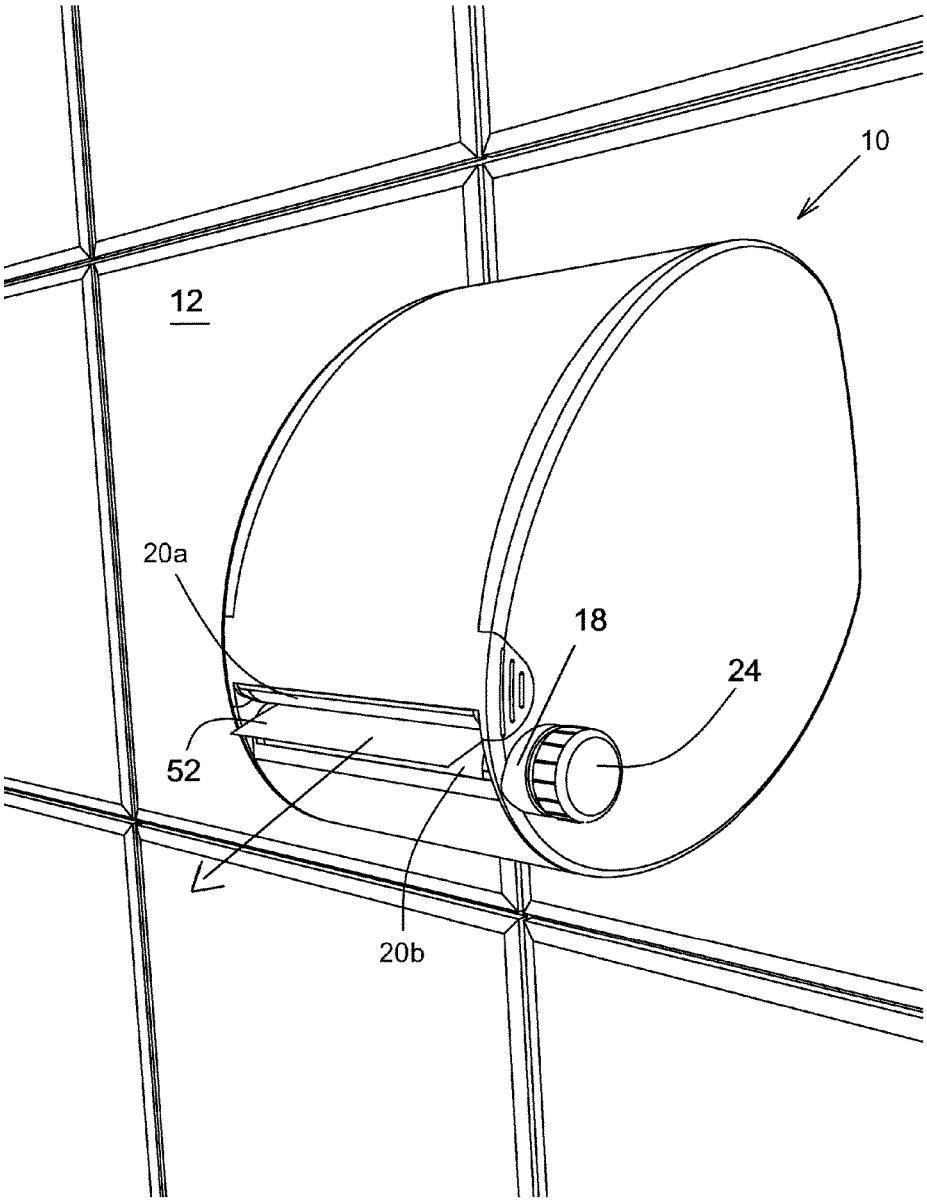
FIG. 4 is a perspective view of the damp sheets dispenser of FIG. 1, at the closed state.

Cover 16 includes a main surface 76, being parallel to stationary rear surface 54; and side walls 72, extending from main surface 76, perpendicular thereto, thus being parallel to stationary side walls 56. Upon closing cover 16, at least a portion of each of side walls 72 of cover 16 overlap with its stationary rear surface 56, thus being disposed aside and parallel thereto, thus being hidden thereby at the closed state, as depicted in FIG. 4. End strips 74 of side walls 72 press and seal with strips 22 extending from stationary side walls 56, and being shaped complementary to end strips 74 of side walls 72 of cover 16. Thus, cover 16 is sealed to the stationary surfaces all around.

The moving parts are as well sealed, and thus round parts are preferred. Namely, cylinder 20B provides sealing to a complementary portion 28 of bottom surface 58; cylinder 20A provides sealing to a complementary portion 30 of bottom surface 58; and the rotating lump 60 of cover 16 provides sealing to a complementary portion 26 of rear surface 54 (denoted in FIG. 1).

Figure 3:
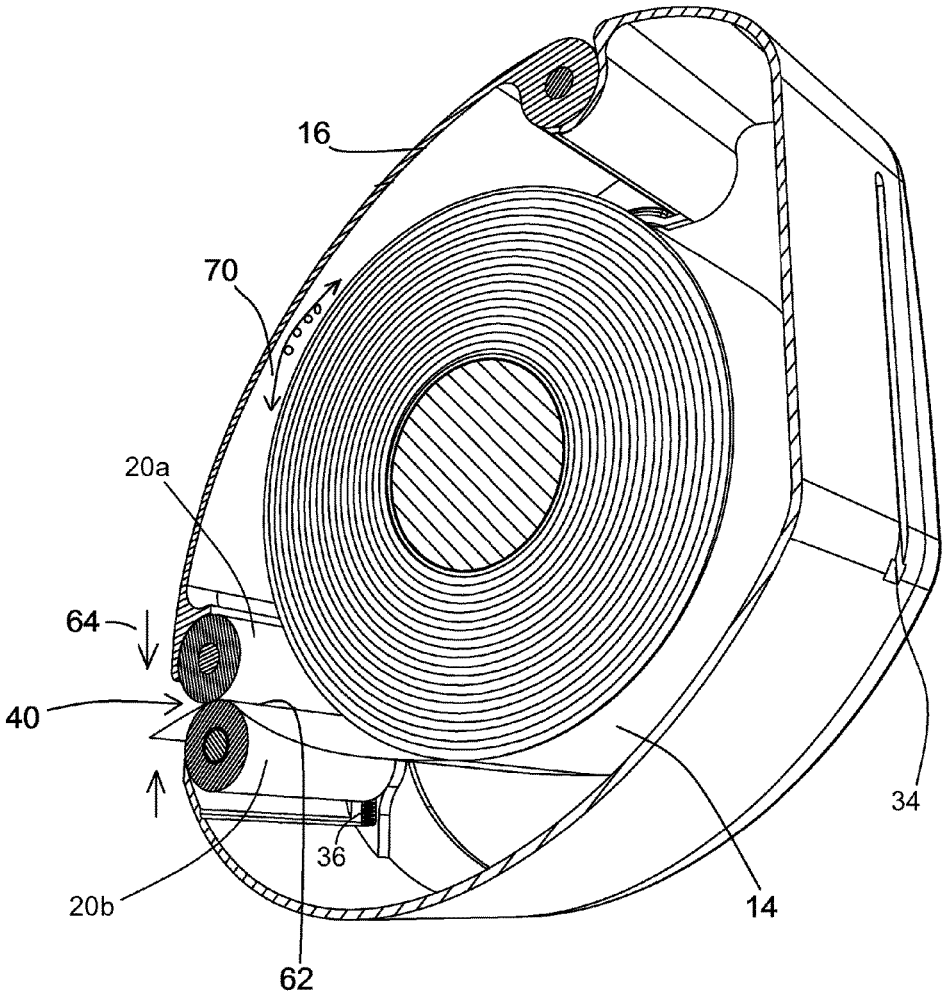
FIG. 3 is a sectional perspective view of the damp sheets dispenser of FIG. 1, at the closed state.

FIG. 3 is a sectional perspective view of the damp sheets dispenser of FIG. 1, at the closed state.

Upon closing cover 16, the dispensing slit 40 of compartment 50 is sealed by rotatable cylinders 20A and 20B being pressed one towards the other, as shown by arrow 64, while pressing a line 62 of damp roll 14 in between.

Cover 16 may be sufficiently springy, as illustrated by a representative springy element 70, for providing the pressure of rotatable cylinders 20A and 20B one towards the other. In addition, a spring 36 may directly cylinder 20*b*.

FIG. 4 is a perspective view of the damp sheets dispenser of FIG. 1, at the closed state.

Pulling of sheet 52, instead of rolling damp roll 14 for dispensing therefrom, might tear it, due to cylinders 20A and 20B pressing line 62 of damp roll 14.

Thus, damp sheets dispenser 10 includes a handle 24 or a motor 18, for rotating at least one of rotatable cylinders 20A and 20B.

Figure 5:
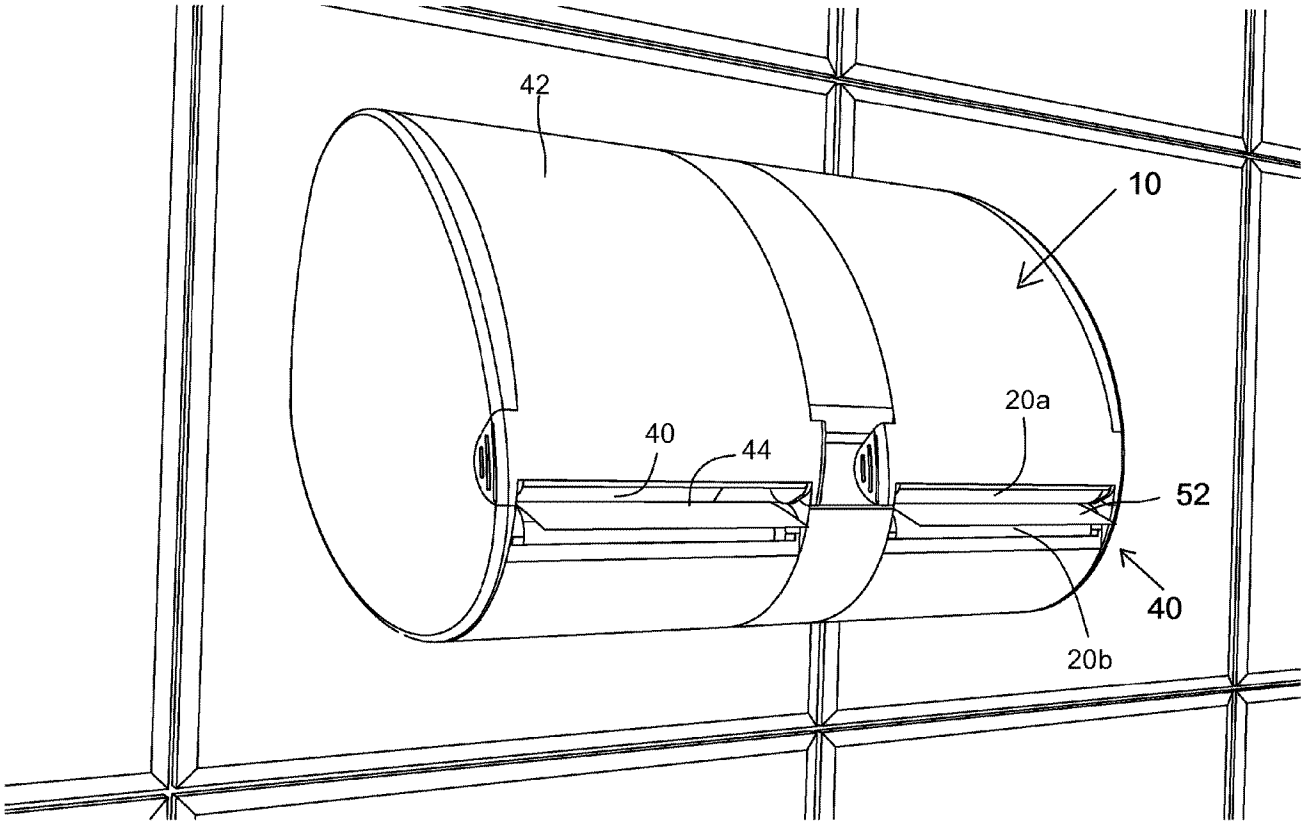
FIG. 5 is a perspective view of the damp sheets dispenser of FIG. 1, at the closed state, and a prior art paper dispenser adjacent thereto.

FIG. 5 is a perspective view of the damp sheets dispenser of FIG. 1, at the closed state, and a prior art paper dispenser adjacent thereto.

In contrast to damp sheets dispenser 10, whose rotatable cylinders 20A and 20B close dispensing slit 40 thereof, dispensing slit 40 of a paper dispenser 42 for dispensing dry paper 44, is open.

Thus, in one aspect, the invention is directed to a damp sheets dispenser (10), including a compartment (50), for housing therein a damp roll (14), the compartment (50) including:

an openable cover (16), for inserting the damp roll (14) into the compartment (50) therethrough, and for closing the compartment (50), for dispensing the damp roll (14) therefrom;

a slit (40), for dispensing from damp roll (14) therethrough at the closed state of the compartment (50);

two rotatable cylinders (20A, 20B) disposed filling the slit (40), at the closed state of the compartment (50), for dispensing the damp roll (14) therethrough;

at least one sealing (22,26,28,30), for sealing the openable cover (16) to surfaces (54, 58), 56) of the compartment (50) disposed adjacent thereto, thereby at the closed state, the compartment (50) seals the damp roll (14) housed therewithin, thereby maintaining the damp roll (14) damped.

The compartment (50) may further include:

rotating means (18,24), for rotating at least one of the rotatable cylinders (20A, 20B) at the closed state of the compartment (50), thereby not requiring pulling the damp roll (14) against the sealing of the compartment (50).

The rotating means (18,24) may constitute a handle (24), for manually rotating at least one of the rotatable cylinders (20A, 20B) at the closed state of the compartment (50).

The rotating means (18,24) may constitute a motor (18), for rotating at least one of the rotatable cylinders (20A, 20B) at the closed state of the compartment (50).

The compartment (50) may further include:

a springy character (70,36), for pressing the two rotatable cylinders (20A, 20B) one towards the other upon closing the compartment (50), and for pressing a line (62) of the damp roll (14) therebetween.

The openable cover (16) preferably is openable via rotation thereof, and the rotation is preferably via complementary round elements (26,60) for providing sealing thereof.

In another aspect, the invention is directed to a damp sheet (14), constituting a roll, for dispensing therefrom by a dispenser (10) including a compartment (50), including:

an openable cover (16), for inserting the damp roll (14) into the compartment (50) therethrough, and for closing the compartment (50), for dispensing the damp roll (14) therefrom;

a slit (40), for dispensing from the damp roll (14) therethrough, at a closed state of the compartment (50);

two rotatable cylinders (20A, 20B) disposed for filling the slit (40), at the closed state of the compartment (50); and at least one sealing (22), for sealing the openable cover (16) to surfaces (54, 58), 56) adjacent thereto, thereby the compartment (50) seals the damp roll (14) housed therewithin at the closed state, thereby maintaining the damp roll (14) damped.

In the figures and/or description herein, the following reference numerals (Reference Signs List) have been mentioned:

numeral 10 denotes the damp sheets dispenser, according to one embodiment of the invention;

numeral 12 denotes a wall of the building, to which the damp sheets dispenser is installed;

numeral 14 denotes a damp roll, for dispensing each time, a sheet from the end thereof;

numeral 16 denotes a movable cover of the dispenser; the moving may be rotation or linear sliding;

numeral 18 denotes a motor;

numerals 20A and 20B denote two rotatable cylinders being pressed one towards the other, for closing an opening therebetween;

numeral 22 denotes a sealing;

numeral 24 denotes a handle;

numeral 26 denotes a portion of the compartment shaped complementary to a round shape of a lump of the movable cover, for sealing therewith;

numerals 28 and 30 denote portions of the compartment each shaped complementary to the round shape of one of the cylinders, for sealing therewith;

numeral 34 denotes a slit, for hanging the dispenser to the building;

numeral 36 denotes a spring, for pressing one cylinder towards the other;

numeral 40 denotes the slit, through which the end of the roll is directed outwards;

numeral 42 denotes a prior art paper dispenser, i.e., which is not sealed, and thus is suitable for dispensing dry paper only;

numeral 44 denotes dry paper;

numeral 50 denotes the sealed compartment;

numeral 52 denotes a sheet, for tearing from the damp roll;

numeral 54 denotes the rear surface of the compartment;

numeral 56 denotes the side surface of the compartment;

numeral 58 denotes the bottom surface of the compartment;

numeral 60 denotes a lump of the cover;

numeral 62 denotes the line of the damp roll, disposed and pressed currently between the cylinders;

numeral 64 denotes an arrow; and numeral 70 denotes the springy character of the cover, such as the natural springiness of the plastic surface of the cover.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A damp sheets dispenser, comprising a compartment, for housing therein a damp roll, said compartment comprising:

a stationary rear surface (54);

stationary side surfaces (56), extending from said stationary rear surface (54);

a cover, being rotatable in relation to said stationary surfaces (54, 56), for inserting the damp roll into said compartment therethrough, and for forming said compartment at a closed state of said cover, for dispensing the damp roll therefrom, said cover comprising a main surface (76) and side walls (72) extending from said main surface (76), being parallel to said stationary side surfaces (56), wherein at least a portion said side walls (72) overlaps with said stationary side surfaces (56) at said closed state;

a slit, for dispensing the damp roll therethrough at said closed state of said cover;

two rotatable cylinders disposed filling said slit, at the closed state of said cover, for dispensing the damp roll therethrough;

at least one sealing, for sealing said rotatable cover to said stationary surfaces, said at least one sealing comprising strips (22) extending from said stationary side surfaces (56) and being shaped complementary to end strips (74) of said side walls (72) of said cover (16), thereby said strips (22, 74) attach one another upon said overlapping of said side walls (72) with said stationary side surfaces (56), thereby at the closed state, said compartment seals the damp roll housed therewithin, thereby maintaining the damp roll damped.

2. A damp sheets dispenser according to claim 1, wherein said compartment further comprises:

rotating means, for rotating at least one of said rotatable cylinders at the closed state of said cover, thereby not requiring pulling said damp roll against the sealing of said compartment.

3. A damp sheets dispenser according to claim 2, wherein said rotating means comprises a handle, for manually rotating said at least one of said rotatable cylinders at the closed state of said cover.

4. A damp sheets dispenser according to claim 2, wherein said rotating means comprises a motor, for rotating said at least one of said rotatable cylinders at the closed state of said cover.

5. A damp sheets dispenser according to claim 1, wherein said compartment further comprises:

a springy character, for pressing said two rotatable cylinders one towards the other upon closing said compartment, and for pressing a line of the damp roll therebetween.

6. A damp sheets dispenser according to claim 1, wherein said rotation of said cover is via complementary round elements for providing sealing thereof.

7. A damp sheet, comprising a roll, for dispensing therefrom by a dispenser comprising a compartment, comprising:

a stationary rear surface (54);

stationary side surfaces (56), extending from said stationary rear surface (54);

a cover, being rotatable in relation to said stationary surfaces (54, 56), for inserting said damp roll into said compartment therethrough, and for forming said compartment at a closed state of said cover, for dispensing from said damp roll, said cover comprising a main surface (76) and side walls (72) extending from said main surface (76), being parallel to said stationary side surfaces (56), wherein at least a portion said side walls (72) overlaps with said stationary side surfaces (56) at said closed state;

a slit, for dispensing from said damp roll therethrough, at said closed state of said cover;

two rotatable cylinders disposed for filling said slit, at the closed state of said cover; and at least one sealing, for sealing said rotatable cover to said stationary surfaces, said at least one sealing comprising strips (22) extending from said stationary side surfaces (56) and being shaped complementary to end strips (74) of said side walls (72) of said cover (16), thereby said strips (22, 74) attach one another upon said overlapping of said side walls (72) with said stationary side surfaces (56), thereby said compartment seals said damp roll housed therewithin at the closed state, thereby maintaining said damp roll damped.

* * * * *